United States Patent [19]

Fish et al.

[11] Patent Number: 4,617,810

[45] Date of Patent: Oct. 21, 1986

[54] SLIDING GLASS DOOR LOCK

[75] Inventors: Aaron M. Fish, Cote St. Luc; Adamo M. D'Intino, Riviere-des-Prairies; Frank G. Moessner, Pointe Claire; Stanley S. Mazoff, Dollard-des-Ormeaux, all of Canada

[73] Assignee: Ilxo Unican Corp., Rocky Mount, N.C.

[21] Appl. No.: 762,553

[22] Filed: Aug. 5, 1985

[51] Int. Cl.[4] ..... E05B 73/00

[52] U.S. Cl. ..... 70/14; 70/368

[58] Field of Search ..... 70/14, 368, 95–100, 70/367

[56] References Cited

U.S. PATENT DOCUMENTS

| | | | |
|---|---|---|---|
| 1,761,092 | 6/1930 | Shinn | 70/368 |
| 1,864,883 | 6/1932 | Anderson | 70/14 |
| 2,140,066 | 12/1938 | White | 70/14 |
| 2,141,748 | 12/1938 | Hansen | 70/368 |

*Primary Examiner*—Robert L. Wolfe

*Attorney, Agent, or Firm*—Iran Milton Jones

[57] ABSTRACT

A sliding glass door lock having a ratchet locking bar fastened to one sliding door, and a locking mechanism having a housing forming an abutment engaging the other sliding door. A window is formed in a base plate of the housing which lies adjacent to the door in the locked position and allows access for release and replacement of the cylinder lock when the lock is unlocked.

12 Claims, 5 Drawing Figures

SLIDING GLASS DOOR LOCK

This invention relates to locks and, more particularly, to a sliding door lock having a locking bar with a serrated edge forming a ratchet with a dog in the lock mechanism. The locking bar clamps the edge of one of the sliding doors and the lock housing forms an abutment engaging the edge of the other of the doors. A window is provided in an end plate of the housing which normally lies adjacent to the door in the locked position, and which permits access to a locking cylinder for release and replacement of the cylinder when the lock is unlocked.

Sliding door locks for display cases usually have a locking mechanism in a housing mounted directly on the glass of the sliding door by drilling through the glass or by bonding the housing of the locking mechanism to the glass surface. Drilling and mounting in this manner may be costly and may incur breakage. Bonding may be unreliable in that the housing may loosen from the glass surface and, accordingly, neither of these methods are entirely satisfactory. Accordingly, the applicants' invention overcomes the disadvantages of the above methods of mounting the locking mechanism.

The applicants' invention provides for a door lock having a locking bar clamping on the edge of one of the sliding doors. The locking bar has a serrated edge on the opposite end, which extends into the locking mechanism. The locking mechanism has a spring loaded dog which engages the serrated edge of the locking bar to adjustingly tighten the housing of the locking mechanism to a position abutting the ddge of the other sliding door, to thereby lock the doors. The housing is formed with a plate on the underside of the locking mechanism which is adjacent to the sliding door in the normally locked position. This plate is provided with a window for access to the retainer for holding the locking cylinder in the locking mechanism. By access through the window, the retainer can be released and the cylinder lock can be released and replaced to provide a new key and combination for the lock.

It is an object of this invention to provide a sliding door lock having a locking bar which clamps over one edge of the sliding door, and a locking mechanism having a housing forming an abutment engaging the edge of the other door.

It is another object of this invention to provide a sliding door lock having a locking bar clamping one edge of the door and a locking mechanism having a housing forming an abutment at the edge of the other door. The housing forms a plate having a window for access to release and replace the locking mechanism.

It is a further object of this invention to provide a sliding door lock with a locking bar clamping one edge of a sliding door and a locking mechanism having a housing and a spring-biased dog forming a ratchet with the locking bar for locking the doors. The housing of the locking mechanism is formed with a plate lying adjacent to the door in the normal locked position, and an access window in the plate for release and replacement of the cylinder lock when the locking device is unlocked.

The objects of the invention are accomplished in a sliding door lock having a locking bar with a hooked end clamping one edge of a door. A serrated edge of the locking bar extends into a locking mechanism to engage a spring-loaded ratchet dog. A key operated cam is provided to release the dog to unlock the door locking mechanism. A plate is provided in the housing which lies adjacent to the side of the door in the normal locking position. A window is provided in the plate for access to release the retainer for the locking cylinder of the locking mechanism and replace the cylinder with a new key and locking cylinder.

Referring to the drawings, the preferred embodiment of this invention is illustrated.

Figure 1:
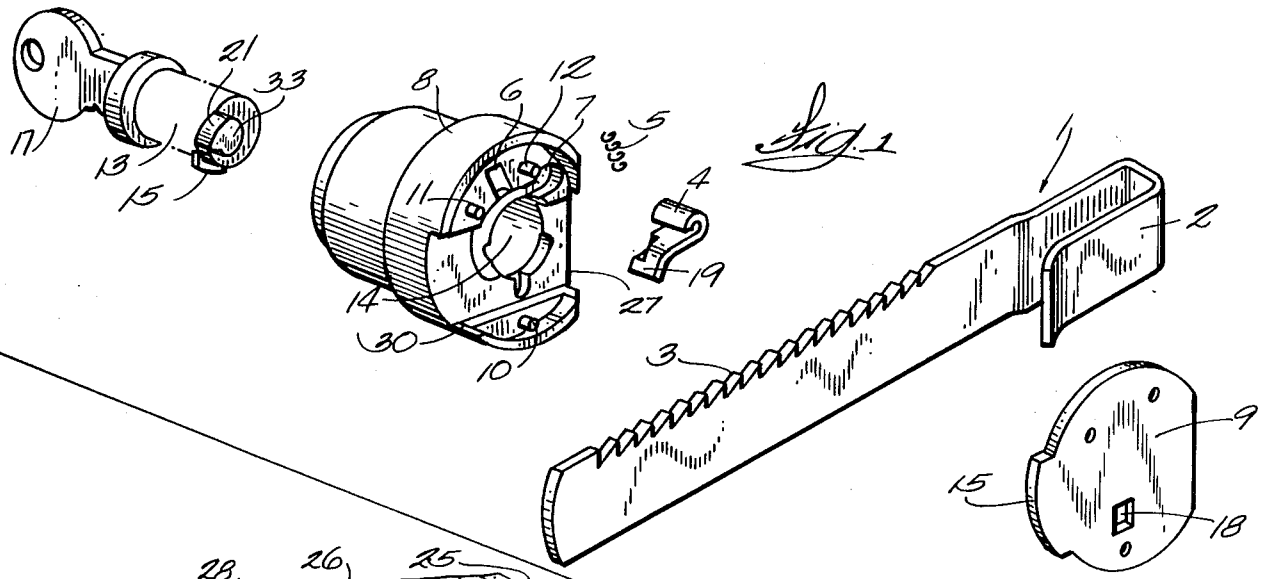
FIG. 1 illustrates an exploded view of the locking mechanism for the sliding doors.

Referring to the drawings, FIG. 1 illustrates an exploded view of the locking device. The locking bar 1 is formed with a hook 2 on the one end and a serrated edge 3 on the other end, for engaging a dog 4. The dog 4 is biased to an engaging position by the spring 5. The spring 5 and dog 4 are received in the recesses 6 and 7 of the housing 8. The end plate 9 is fastened to the housing 8 by the three rivets 10, 11 and 12, when in the assembled position.

Figure 4:
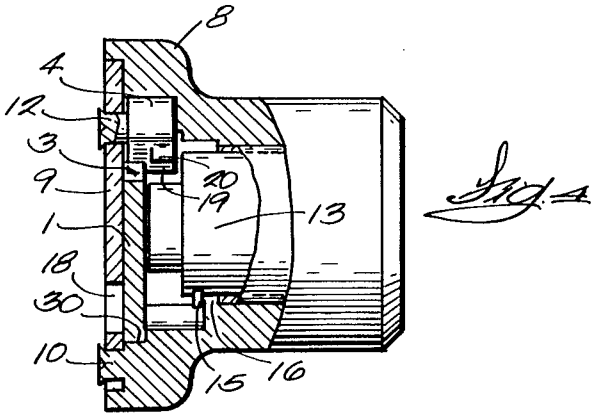
FIG. 4 is a cross sectional view at right angles to the cross section view as shown in FIG. 3.

The key cylinder 13 is received in the cylindrical opening 14 of the housing 8. The retainer 15 is spring-biased to engage a flange 16, as shown in FIG. 4. The retainer 15 normally holds the key cylinder 13 in the assembled position. The key 17 provides a means for operating the key cylinder 13.

The end plate 9 is formed with a window 18 to provide access to lift the retainer 15 allowing the key cylinder to be retracted from the opening 14 in the housing 8. This allows an operator to replace the key cylinder and the key and to change the lock if so desired.

The dog 4 is provided with a locking edge 19 to selectively engage the serrated edge 3 of the locking bar 1. The dog also is provided with a cam follower surface 20 for engaging the cam surface 21 of the key cylinder 13. As the key cylinder 13 is rotated, the cam surface 21 engages the follower surface 20 to lift the dog from the serrated edge, allowing unlocking of the locking mechanism.

The retainer 15, as shown, is normally spring-biased to an engaging position locking the cylinder 13 in the housing 8. A retainer, as shown, could be replaced with a snap ring locking in a recess on the housing, if so desired.

Figure 3:
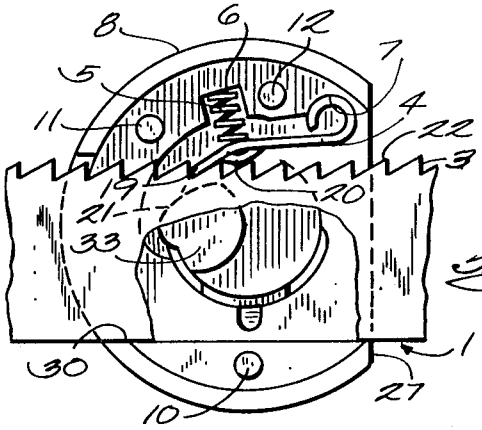
FIG. 3 is a cross section view showing the serrated edge of the locking bar locked with a spring-biased ratchet dog.

FIG. 3 shows the dog 4 biased by the spring 5 to engaging position with a tooth 22 of the serrated edge 3. The cam surface 21 is shown in the retracted position, but can be rotated approximately ninety degrees in a clockwise direction, as shown in FIG. 3, to engage the follower surface 20 when the lock is unlocked. This allows free movement of the locking bar 1 to withdraw the locking bar from the locking mechanism.

Figure 2:
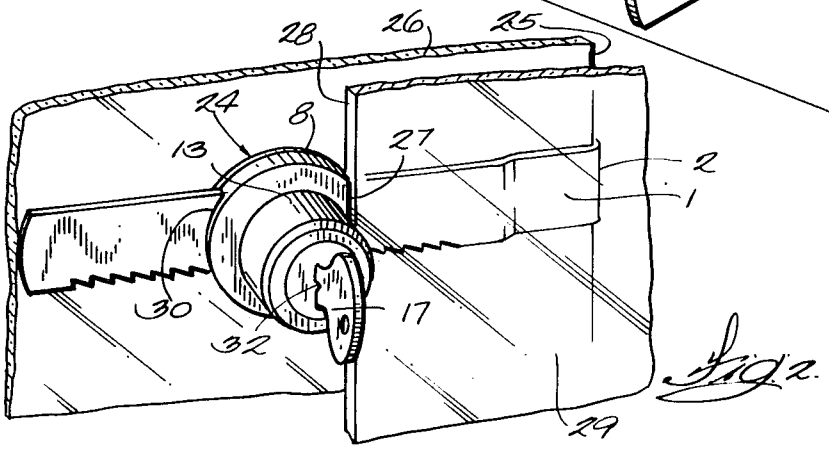
FIG. 2 illustrates the locked position of the locking mechanism on the sliding doors.
Figure 5:
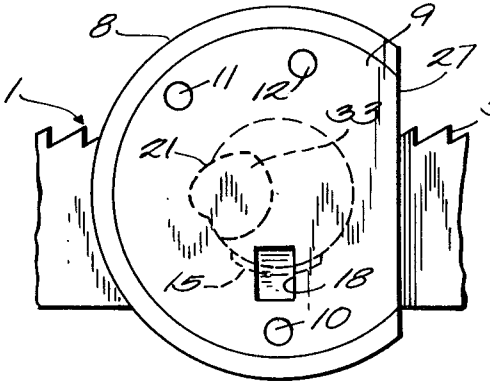
FIG. 5 is an end view of the locking mechanism showing the cam on the key cylinder in the locking mechanism.

FIG. 5 shows the window 18 and the retainer 15 in the locking mechanism. FIG. 2 shows the locking mechanism 24 is shown in the assembled position in which the hook 2 on the end of the locking bar 1 engages the edge 25 of the door 26. The housing 8 of the locking mechanism 24 forms a flat surface 27 which engages the edge 28 of the window 29.

The operation of the locking device will be described in the following paragraphs.

When the sliding doors 26 and 29 are to be locked, the locking bar 1 is positioned with the hook 2 on the edge 25 of the door 26. The end of the bar having the serrated edge 3 of the locking bar is then inserted in the slot 30, as shown in FIG. 4, and the locking mechanism is slid on the locking bar to the position shown, where the edge 27 of the housing 8 engages the edge 28 of the door 29. In this manner, the door cannot slide and the show case cannot be opened.

To unlock the locking mechanism, the key 11 is inserted in the slot 32 and the key cylinder 13 is rotated in a clockwise direction, as viewed in FIG. 3. Rotation of the key cylinder also carries the cam 33, causing the cam surface 21 to engage the cam follower 20 and thereby lift the dog 4 against the biasing force of the spring 5. This allows the locking bar 1 to freely move from the locking mechanism 24 and the device is unlocked.

If it should be desired to change the key cylinder 13, a pick may be used to release the retainer 15 through the window 18. When the retainer is released, the key cylinder 13 can be withdrawn from the opening 14 and a new key cylinder replaced to provide a new combination for the lock, if so desired.

The embodiments of the invention in which an exclusive property or privilege is claimed are defined as follows:

1. A sliding door locking means comprising: a locking bar forming a hook for clamping the edge of a first door, a housing forming a cross passage receiving said bar, a locking mechanism including a key cylinder received in said housing, said key cylinder including a retainer for holding said key cylinder in said housing, said housing forming an abutment at the edge of the second door, said locking mechanism locking the end of said locking bar when said bar is received in said cross passage of /in/ said housing, said housing defining a wall normally adjacent to said first door when the doors are locked, means defining an access window in said wall, said housing defining an access passage between said window and said retainer for releasing and replacement of /a/ said key cylinder in said lock mechanism when said locking mechanism is unlocked, said bar covering said window when it is received in said cross passage and preventing access to said retainer.

2. A sliding door locking means comprising: a first sliding door, a second sliding door, a locking mechanism including a key cylinder and a locking bar having one end clamping the edge of said first door, a housing defining a cross passage receiving said bar and enclosing said locking mechanism, an end of said locking bar extending into said housing and locking in said locking mechanism, said locking mechanism including a key cylinder having a retainer, said housing forming an abutment at the edge of the second door and a wall lying adjacent said first door, said wall defining an access window, said housing defining an access passage between said window and said retainer for release and replacement of /a/ said key cylinder in the locking device in said housing, said bar covering said window when it is received in said cross passage and preventing access to said retainer.

3. A sliding door locking means comprising: a locking bar including an end for holding the edge of a first door, a housing defining a cross passage receiving the other end of said bar, a locking mechanism locking the other end of said locking bar and including a housing forming an abutment for engaging the edge of a second sliding door, said locking mechanism including a key cylinder including a retainer for retaining said key cylinder /retained/ within said housing, said housing including a wall normally lying adjacent said second /a/ door when said lock mechanism is locked, said wall defining an access window, said housing defining an access passage from said window to said retainer for release and replacement of said key cylinder when said locking mechanism is unlocked, said bar interrupting said access passage and covering said window when said locking mechanism is locked.

4. A sliding door locking means as set forth in claim 1, wherein said locking bar forms a serrated edge on the end of said locking bar received in said housing.

5. A sliding door locking means as set forth in claim 3, wherein said locking bar defines a hook for clamping the one edge of the first door.

6. A sliding door locking means as set forth in claim 3, including means defining a serrated edge on the end of said locking bar received in said locking mechanism, a spring loaded dog in a ratchet means of said locking mechanism for engaging said serrated edge in said locking bar.

7. A sliding door locking means as set forth in claim 1, including a cylindrical housing enclosing said locking mechanism, a base plate on the base of said housing defining said window.

8. A sliding door locking means as set forth in claim 3, including a retainer holding said key cylinder in said housing, a plate in said housing defining said window providing access for releasing said retainer and allowing replacement of said key cylinder when said lock is in the unlocked position.

9. A sliding door locking means as set forth in claim 1, including /a/ key cylinder in said locking mechanism, /s/ a plate at the base of the housing adjacent to the sliding door defining said window.

10. A sliding door locking means as set forth in claim 3, including a serrated edge on said locking bar, a key adapted for rotating said key cylinder, a cam on the end of said key cylinder, a dog in said housing pivotally positioned and spring-biased to an engaging position with the serrated edge of said locking bar, said cam on said key cylinder biasing said dog against the force of said spring to unlock said locking mechanism.

11. A sliding door locking means as set forth in claim 3, including, a resiliently biased retainer means on said cylinder in said housing.

12. A sliding door locking means as set forth in claim 1, including means defining a serrated edge on one end of said locking bar, a spring-loaded dog in said locking mechanism having a locking edge for selectively engaging the serrated edge of said locking bar when said locking mechanism is locked, a cam follower surface on said dog for selectively engaging a cam, said key cylinder defining a cam surface for selectively engaging said cam follower in said locking mechanism, a key for operating said key cylinder and rotating said cam to raise said dog from engagement with the serrated edge and thereby unlock said locking device.

* * * * *